US005160091A

United States Patent [19]

Hesse

[11] Patent Number: 5,160,091

[45] Date of Patent: Nov. 3, 1992

[54] TOY VEHICLE TRACK

[76] Inventor: Kurt Hesse, Waldstrasse 36, 8510 Fürth, Fed. Rep. of Germany

[21] Appl. No.: 754,297

[22] Filed: Sep. 4, 1991

Related U.S. Application Data

[63] Continuation of Ser. No. 264,919, Oct. 27, 1988, abandoned.

[30] Foreign Application Priority Data

Oct. 27, 1987 [DE] Fed. Rep. of Germany ..... 8714278

[51] Int. Cl.[5] ..... E01B 23/00

[52] U.S. Cl. ..... 238/10 E; 191/22 C

[58] Field of Search ..... 238/10 A, 10 E, 10 F; 191/22 C, 4, 29 R; 446/444, 455

[56] References Cited

U.S. PATENT DOCUMENTS

| | | | |
|---|---|---|---|
| 1,511,600 | 10/1924 | Fergusson | 191/29 R |
| 2,171,634 | 10/1939 | Rexford et al. | 238/10 E X |
| 4,139,071 | 2/1979 | Tackett | 191/22 C X |
| 4,179,066 | 12/1979 | Teter | 238/10 E |
| 4,217,727 | 8/1980 | Fetty et al. | 238/10 E X |
| 4,225,081 | 9/1980 | Ikegame | 238/10 E |
| 4,241,875 | 12/1980 | Vandenbrink | 238/10 F |
| 4,252,272 | 2/1981 | Fischer | 238/10 E |
| 4,372,489 | 2/1983 | Lee | 238/10 F |
| 4,540,119 | 10/1985 | Neuhiera | 238/10 F X |
| 4,632,038 | 12/1986 | Lawrence | 238/10 E X |
| 4,697,812 | 10/1987 | Rudell et al. | 238/10 F X |
| 4,941,610 | 7/1990 | Frauca | 238/10 F X |

FOREIGN PATENT DOCUMENTS 8602856 5/1986 PCT Int'l Appl. ..... 238/10 E

*Primary Examiner*—Robert J. Spar
*Assistant Examiner*—Scott L. Lowe
*Attorney, Agent, or Firm*—Browdy and Neimark

[57] ABSTRACT

A toy vehicle track with toy vehicles having an electric drive motor disposed in the chassis thereof. The track is formed of segments which are connected by plugging together. The electric drive motor in the vehicles is supplied with electricity via collectors and conductors placed in the track for uninterrupted operation over a period of time. When electrical connection with a net fails or is terminated, the vehicles can be operated over a further preset length of time. The segments are removably or fixedly connected with conductors along the entire track. The vehicles have collectors in contact with the conductors and a chargeable power source serving as an electric buffer. The power source and the collectors are simultaneously in permanent connection with the drive motor. If the power supply is cut off from the electric net, the internal power source is automatically activated, and permits further operation until discharged. The conductors on the segments are formed by metal foil or metal foil segments, by electrically conductive formed parts clampingly clipped to the individual segments, which are either removably clippable to the edge members or on the segments in the area of the track surfaces, or they are irremovably fixed with the segments.

12 Claims, 1 Drawing Sheet

FIG. 1
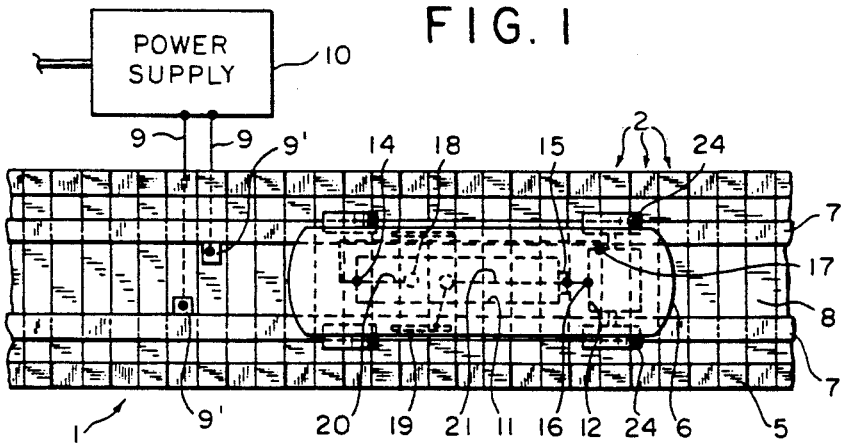
FIG. 2
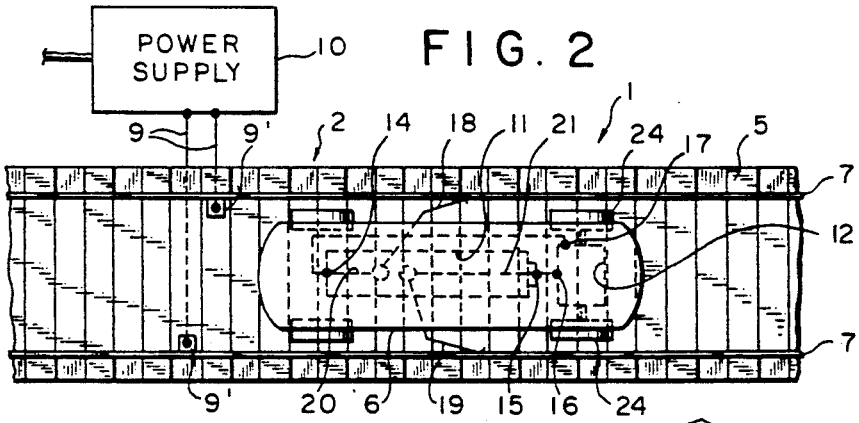
FIG. 3
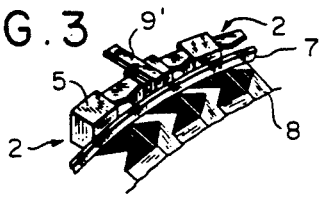
FIG. 4
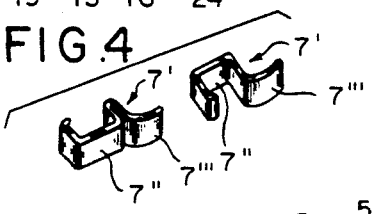
FIG. 5
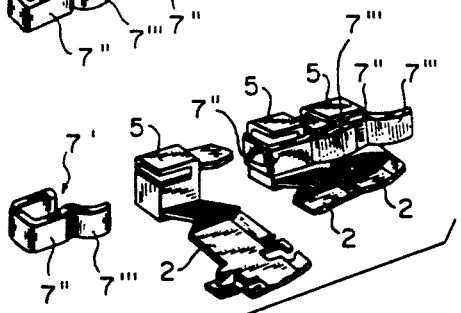
FIG. 6
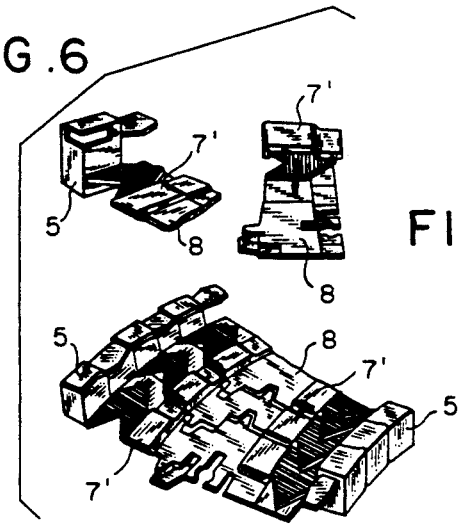
FIG. 7
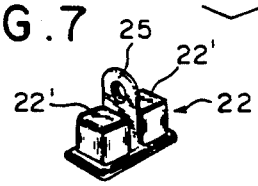
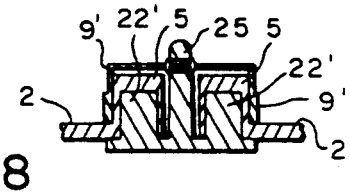
FIG. 8

TOY VEHICLE TRACK

This application is a continuation of application Ser. No. 07/264,919, filed Oct. 27, 1988, now abandoned.

FIELD OF THE INVENTION

The invention relates to a toy vehicle track with toy vehicles having an electric drive motor disposed in the chassis and with a track formed in particular by segments which can be connected by plugging together.

BACKGROUND OF THE INVENTION

It is known in connection with toy vehicles having an electric motor to supply the latter with electricity via collectors and conductors placed in the track. The conductors are permanently connected to an electrical supply source. A disadvantage of this is that these toy vehicles can only be used as long as the electrical supply source is connected with the electrical supply net. Because of this there is the negative result that toy vehicles, which for advertising purposes along tracks in display windows, may immediately stop running when the electrical supply source is shut off, e.g. when the store closes, for which reason advertising beyond the time of closing of the store is no longer possible, because the vehicles have stopped. It is further known to operate toy vehicles on the track by means of an independent power source, e.g. a battery. However, after a relatively short running time these toy vehicles require the use of fresh power sources. The disadvantage here is that to change the power source the operation must be interrupted. Furthermore, the speed of movement of the toy vehicles is unintentionally slowed because of the decreasing power of the power source.

It is an object of the invent on to assure uninterrupted operation over a period of time of optional length on a toy track by connection with the electrical net and, when the connection with the net fails or is terminated, to make further operation possible over a subsequently preset length of time.

SUMMARY OF THE INVENTION

This object is attained in the present invention in that the track segments have conductors which are removably fixed along the entire track and which are connected with the terminals of a power supply source, in that the toy vehicle has collectors which are in contact with the conductors and a chargeable power source used as an electrical buffer, and in that the power source and the collectors are simultaneously in permanent contact with the drive motor. In this way the toy vehicle is supplied with voltage delivered by the electrical net via the conductors over, e.g., the period of time the store is open, which assures an uninterrupted operation of the toy vehicle while, if the power source is detached from the electrical net, the internal power source automatically takes over and makes possible a subsequent further operation until the internal power source is exhausted. This makes it possible, for example, to continue operation after closing of the store and cut-off of the supply source from the net during the evening hours which perhaps follow. Furthermore, permanent charging of the internal power source can be achieved with low amperages over long periods of time, thus avoiding damage of the internal power source which is known to occur during fast charging. In a preferred way the power source is designed in such a way that it supplies a voltage generally 50% higher than the operational voltage of the chargeable internal power source.

It is understood that the conductors can be fixed to the segments in any desired manner. It is provided that the conductors are fixed on the segments by adhesion. The conductors may be provided as continuously applied ribbon-like foil or as foil segments of a metallic material in contact with each other. For practical reasons the metal foil or metal foil sections are made self-adhesive, so that after the track has been set up, it is possible to provide it with conductors in a particularly simple way.

It is furthermore provided that the metal foils have fixed connectors to which electrical conductors connected with the power source can be connected. For example, parts formed of sheet metal and disposed in the segments may be used as connectors. It is also conceivable to use short foil sections as connectors which are in contact with the conductors. It is to be understood that the connectors may also be provided in any other desired manner. The electrical conductors themselves may be connected to the connectors by soldering, crimping or the like.

In a further embodiment of the invention it is provided to dispose the conductors in the driving surfaces and/or on the lateral guide elements of the segments. Depending on the disposition of the conductors, all that is needed is the assignment of correspondingly formed collectors. As desired, brushes, parts formed of metal or the like and used as wipers may serve as collectors.

Finally, it is provided to form the collectors as formed parts made of an electrically conductive material which can be clampingly clipped to the segments. The formed parts have spring segments which are in contact with the formed parts of neighboring segments in order to provide continuous conductors on the track. It is to be understood that the formed parts can be simply clipped to the guide elements and thus can be exchangeable. Preferably the formed parts are fixed by crimping or with the help of clamping elements, however, it is also conceivable to fixedly connect the formed parts with the segments. Finally there is the possibility to fix the formed parts on the segments by extrusion from the material of the latter.

To increase the appeal of the game it is furthermore provided that the segments have hollow guide members, downwardly open, on both sides of the driving surface and that, by insertion of connecting elements provided with clamping bodies into the hollow spaces of the guide members, multi-track segments can be fixed side-by-side and that the conductors of the fixedly adjacent segments are simultaneously in permanent contact by means of tangs or protrusions made of an electrically conductive material and disposed centrally between the clamping bodies. A particularly simple design of the connecting elements results when the clamping bodies and the tangs are made in one piece of an electrically conductive material. Contact can be made by mere touching of connecting members which are in contact with the conductors or by soldering or crimping of the connecting members with the tangs.

BRIEF DESCRIPTION OF THE DRAWINGS

The invention is described in the drawings by means of an exemplary embodiment.

FIG. 1 is a schematic top view of a section of the toy track,

FIG. 2 is a schematic top view of a section of the toy track according to another embodiment, FIG. 3 is a perspective view of a portion of a track in accordance with the embodiment of FIG. 2, FIG. 4 is a perspective view of conductor sections, FIG. 5 is a perspective view of conductor sections in accordance with FIG. 4 with portions of tracks;

FIG. 6 is a perspective view of a portion of track with a conductor in accordance with a further embodiment, FIG. 7 is a perspective view of a connecting element, and FIG. 8 is a partial section of track members with a connecting element.

DETAILED DESCRIPTION OF THE INVENTION

The track 1 of the toy vehicle track may be formed by a plurality of segments 2 (FIG. 2). The segments 2 have tangs 3 and pincer-like recesses 4 which overlap to provide the connection. Edge elements 5 next to the track surface 8 on both sides are used as lateral guide elements for toy vehicles 6. The track 1 is provided over its entire length with conductors 7 which are formed in the exemplary embodiments in accordance with FIGS. 1 to 5 by flexible strips made of a metallic material, e.g. preferably a self-adhesive metal foil, placed on the segments 2. The conductors 7 are firmly, but removably connected with the segments 2. The conductors 7 are disposed on the segments 2 in the area of the track surface 8 in the exemplary embodiment according to FIG. 1, while in the exemplary embodiment according to FIGS. 2 and 3 the conductors 7 are disposed on the edge elements 5. The conductors 7 are connected via connectors 9' (FIG. 3) and electrical conductors 9 with a power supply 10 which has in a manner known per se a net transformer and a rectifier device.

The toy vehicles contain an internal power source 11, e.g. a rechargeable battery. Additionally, an electrical drive motor 12 is housed in the toy vehicle 6 which exerts a rotary force on the drive wheels 24 of the toy vehicle 6. The connectors 16, 17 of the drive motor are permanently connected with the terminals 14 and 15 and the internal power source 11. Additionally, the toy vehicle 6 has collectors 18, 19 which interact with the conductors 7. The collectors 18, 19 are permanently connected with the terminals 14 or 15 of the power source 11.

In FIG. 1, the collectors 18, 19 are formed by a brush arrangement, while in FIG. 2 spring wires are used as collectors 18, 19, extend laterally beyond the toy vehicle and abut against the conductors 7 with initial tension.

Permanent charging of the power source 11 takes place via the conductors 7, the collectors 18, 19 from the power supply 10. The charge voltage has been selected slightly higher than the operating voltage of the power source 11. At the same time the collectors 18, 19 provide a connection of the drive motor 6 with the power supply 10 via electrical conductors 20, 21.

If the power supply is connected with the net, the toy vehicle 6 can be operated as a net-operated toy vehicle on the track 1. Furthermore, charging of the power source 11, which serves as a buffer, takes place. If the power supply 10 is disconnected from the net, e.g. at the close of business, toy vehicles can be operated on the track 1 by means of the internal power source 11 until the power source 11 is discharged. In this manner the latter makes it possible to continue the operation of the toy vehicle 6 on a track displayed in the display window of a store, e.g. after the closing of the store in the evening, as well as promotional functions, which are important for advertising, during the evening hours.

Varying from this, the conductors 7 in the exemplary embodiments according to FIGS. 4 to 7 are formed by formed parts 7' which each can be pushed onto the edge elements 5 of the segments 2. The formed parts 7' have a generally U-shaped clip part 7'', on each of which a contact piece 7''' is formed which elastically rests on the clip part 7'' of the adjacent segment 2 to form continuous conductors 7. In the exemplary embodiment in accordance with FIG. 6, the formed parts 7' are disposed, in variation, on the segments in the area of the track surface 8. The formed parts 7' are pushed onto the segments 2. It is to be understood that these formed parts 7' have a shape different from the embodiment in accordance with FIGS. 4 and 5.

In FIGS. 7 and 8, a connecting element 22 for segments 2 for the formation of multi-track road segments is shown. The connecting element 22 has clamping elements 22' which can be clampingly pushed from below into the hollow spaces of open design of the edge elements 5. The connecting element 22 has a protrusion 25 between the clamping elements 22' which consists of an electrically conductive material, e.g. metal, and on which the conductors 7 of the tracks 1 are fastened, which have been combined to form a multi-track (FIG. 8).

I claim:

1. A toy vehicle track with at least one toy vehicle, each of said at least one toy vehicle having a chassis in which an electric motor is disposed;

said toy vehicle track comprising a plurality of segments having a first edge, a second edge, a front face, and a back face, interlocking means being disposed on the first edge and the second edge of each of said plurality of segments, so that the front face of each segment may be pivotally engaged to an adjacent segment's back face via said interlocking means and a plurality of segments engaged in a front to back relationship will extend said track in a longitudinal direction;

each of said plurality of segments comprising at least two electrical conductors which are each spring clipped to a section of the segment intermediate the first and second edges and thus between the interlocking means, the electrical conductors having contact tongues for engaging other electrical conductors on another segment of track, so that an uninterrupted path for electrical current is formed between electrical conductors when said segments are engaged in said front to back relationship;

each said at least one toy vehicle being equipped with collectors in contact with said conductors, and a chargeable power source used as an electrical buffer, said power source and said collectors being simultaneously in permanent contact with said drive motor.

2. A toy vehicle track in accordance with claim 1, wherein a power supply supplies voltage to the electrical conductors which is higher by 50% than the operating voltage of the chargeable power source of the toy vehicle.

3. A toy vehicle track in accordance with claim 1, wherein each segment comprises a track surface and lateral edge elements said electrical conductors being chipped on said lateral edge element.

4. A toy vehicle track in accordance with claim 1, wherein the electrical conductors are removably clipped onto the segments by pushing.

5. A toy vehicle track in accordance with claim 1, wherein the electrical conductors are clipped on the segments by a crimping action.

6. A toy vehicle track in accordance with claim 1, wherein each segment comprises a track surface and lateral edge elements said electrical conductors being chipped on said track surface.

7. A toy vehicle track with at least one toy vehicle, each of said at least one toy vehicle having a chassis in which an electric motor is disposed;

said toy vehicle track comprising a plurality of segments having a first edge, a second edge, a front face, and a back face, interlocking means comprising tangs and pincer-like recesses being disposed on the first edge and the second edge of each of said plurality of segments, so that the front face of each segment may be pivotally plugged into an adjacent segment's back face via said interlocking means and a plurality of segments plugged in a front to back relationship will extend said track in a longitudinal direction;

each of said plurality of segments comprising at least two electrical conductors which are each spring clipped to a section of the segment intermediate the first and second edges and thus between the interlocking means, the electrical conductors having contact tongues for engaging other electrical conductors on another segment of track, so that an uninterrupted path for electrical current is formed between electrical conductors when said segments are engaged in said front to back relationship;

each said at least one toy vehicle being equipped with collectors in contact with said conductors, and a chargeable power source used as an electrical buffer, said power source and said collectors being simultaneously in permanent contact with said drive motor.

8. A toy vehicle track in accordance with claim 7, wherein said interlocking means comprising tangs and pincer-like recesses which permit said segments to pivot while plugged together.

9. A toy vehicle track with at least one toy vehicle, each of said at least one toy vehicle having a chassis in which an electric motor is disposed;

said toy vehicle track comprising a plurality of segments having a first edge, a second edge, a front face, and a back face, interlocking means comprising tangs and pincer-like recesses being disposed on the first edge and the second edge of each of said plurality of segments, so that the front face of each segment maybe plugged to an adjacent segment's back face via said interlocking means and a plurality of segments plugged in a front to back relationship will extend said track in a longitudinal direction;

each of said plurality of segments comprising at least two electrical conductors which ar each spring clipped to a section of the segment intermediate the first and second edges and thus between the interlocking means, the electrical conductors having contact tongues for engaging other electrical conductors on another segment of track, so that an uninterrupted path for electrical current is formed between electrical conductors when said segments are engaged in said front to back relationship;

each said at least one toy vehicle being equipped with collectors in contact with said conductors, and a chargeable power source used as an electrical buffer, said power source and said collectors being simultaneously in permanent contact with

10. A toy vehicle track in accordance with claim 9, wherein each of sid at least two electrical conductors are disposed adjacent to either said first edge or said second edge.

11. A toy vehicle track in accordance with claim 9, wherein each of said at least two electrical conductors are disposed near the middle of the segment intermediate said first edge and said second edge.

12. A toy vehicle track in accordance with claim 9, wherein said interlocking means comprising tangs and pincer-like recesses which permit said segments to pivot while plugged together.

* * * * *